US006714165B2

(12) United States Patent
Verstraeten

(10) Patent No.: US 6,714,165 B2
(45) Date of Patent: Mar. 30, 2004

(54) KA/KU DUAL BAND FEEDHORN AND ORTHOMODE TRANSDUCE (OMT)

(75) Inventor: Guy Verstraeten, Antwerp (BE)

(73) Assignee: Newtec CY, Sint-Niklass (BE)

( * ) Notice: Subject to any disclaimer, the term of this patent is extended or adjusted under 35 U.S.C. 154(b) by 0 days.

(21) Appl. No.: 10/031,960

(22) PCT Filed: May 23, 2001

(86) PCT No.: PCT/BE01/00091

§ 371 (c)(1),
(2), (4) Date: May 3, 2002

(87) PCT Pub. No.: WO01/91226

PCT Pub. Date: Nov. 29, 2001

(65) Prior Publication Data

US 2002/0175875 A1 Nov. 28, 2002

(30) Foreign Application Priority Data

May 23, 2000 (EP) ..... 00201836

(51) Int. Cl.[7] ..... H01Q 13/00

(52) U.S. Cl. ..... 343/772; 343/776; 343/785; 343/786; 343/860

(58) Field of Search ..... 343/772, 776, 343/785, 786, 850, 852, 860, 900

(56) References Cited

U.S. PATENT DOCUMENTS

| | | | | |
|---|---|---|---|---|
| 3,265,993 A | | 8/1966 | Davidson | 333/1 |
| 4,862,187 A | | 8/1989 | Hom | 343/786 |
| 5,635,944 A | | 6/1997 | Weinstein | 343/776 |
| 5,668,513 A | * | 9/1997 | Umezu | 333/252 |
| 5,793,334 A | * | 8/1998 | Anderson et al. | 343/786 |
| 6,005,528 A | * | 12/1999 | Preiss et al. | 343/786 |

FOREIGN PATENT DOCUMENTS

| | | |
|---|---|---|
| JP | 05243814 | 9/1993 |
| WO | WO 98/07212 | 2/1998 |

OTHER PUBLICATIONS

European and International search Reports for corresponding application.

* cited by examiner

*Primary Examiner*—Dong Wong
*Assistant Examiner*—Thuy Vinh Tran
(74) *Attorney, Agent, or Firm*—Barnes & Thornburg

(57) ABSTRACT

A dual band, higher and lower frequency range transducer with a circular coaxial waveguide feed is described having a first junction for connection of a lower frequency range outer waveguide of the coaxial waveguide feed to at least two rectangular or ridge waveguides offset from the longitudinal axis of the transducer and a second junction for connection of the at least two rectangular or ridge waveguides to a further waveguide. A third junction is provided for connecting an inner waveguide of the coaxial waveguide feed to a higher frequency range waveguide. The transducer comprises at least first and second parts joined across a first plane substantially perpendicular to the longitudinal axis and including at least a portion of the higher frequency range waveguide extending within the first plane of the join. A seal such as an "O" ring seal may be placed easily in the plane of the join thus preventing moisture ingress. Similarly, a feed horn and input and output ports may be sealingly attached to the first and second parts of the transducer. The first and second junctions are preferably impedance matched turnstile junctions.

16 Claims, 12 Drawing Sheets

OMT + FEED SECTION IN 45° PLANE

OMT + FEED SECTION IN VERTICAL PLANE

DUAL BAND OMT + FEED
SCHEMATIC FRONT VIEW (LOOKING
INTO THE FEED)

OMT + FEED SECTION IN 45° PLANE

OMT + FEED SECTION IN VERTICAL PLANE 50
51
52
53
54

60
26
63
67

67
60
63

60

60
67
63
65

61
64
66
60
26

60

62
26
60
63

60
63

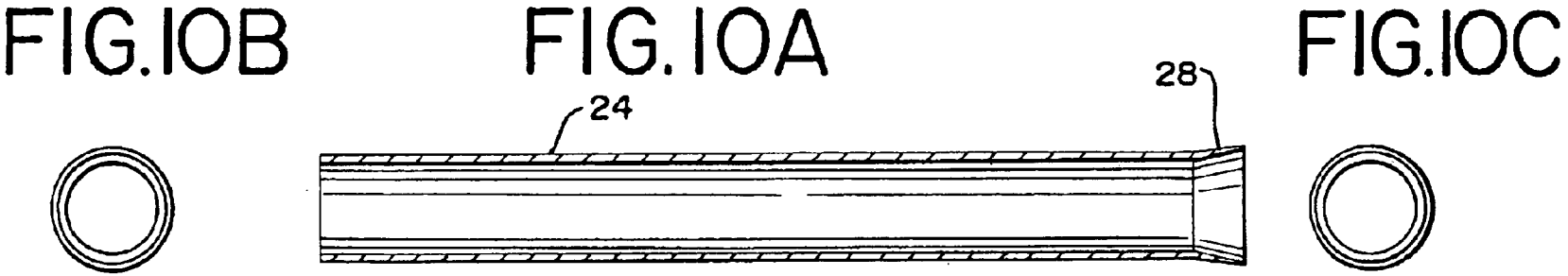
FIG.IOC
28
FIG.IOA
24
FIG.IOB
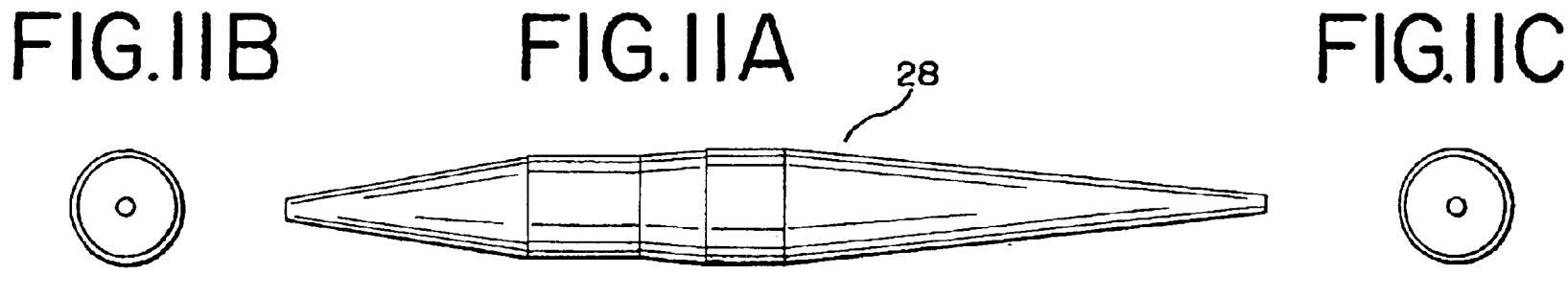
FIG.IIC
28
FIG.IIA
FIG.IIB

KA/KU DUAL BAND FEEDHORN AND ORTHOMODE TRANSDUCE (OMT)

The present invention relates to a dual band feedhorn and orthomode transducer (OMT) for use with a terrestrial satellite parabolic reflector.

TECHNICAL BACKGROUND

Ideally, a dual band feedhorn should be capable of simultaneously illuminating an offset parabolic reflector (with an F/D ratio of about 0.5) at two frequencies, e.g. the Ku and Ka band. The antenna beams produced at both bands should be centred along the same boresight axis. This requires the use of one single feed for both bands.

The main function of the OMT is to provide isolation between the signals at two frequencies, for example the Ka and Ku bands. The OMT should be capable, for instance, of simultaneously transmitting both polarisation directions (vertical and horizontal) of the Ku band from the feedhorn to the Ku band port, and be capable of transmitting one of both polarisation directions (vertical or horizontal) of the Ka band from the Ka band port to the feedhorn. This means there are two possible versions of the OMT depending on the Ka band polarisation direction.

U.S. Pat. No. 5,003,321 describes a dual frequency feed which includes a high frequency probe concentrically mounted with a low frequency feed horn. A concentric circular waveguide has a first turnstile junction mounted adjacent the throat of the low frequency feed, which branches into four substantially rectangular, off axis waveguides extending parallel to the central axis of the waveguide. These waveguides and the low frequency signals conducted through them are then recombined in a second turnstile junction which is coaxial with the low frequency feed, high frequency probe and first turnstile junction. The high frequency feed is introduced in between two of the four parallel off-axis waveguides. The known device is split longitudinally. This split results in complex joining and sealing surfaces at the end of the low frequency feed horn and at the position where the high frequency probe is lead off axis.

SUMMARY OF THE INVENTION

The present invention may provide a dual band, higher and lower frequency range transducer with a circular coaxial waveguide feed, a first junction for connection of a lower frequency range outer waveguide of the coaxial waveguide feed to at least two rectangular or ridge waveguides offset from the longitudinal axis of the transducer, a second junction for connection of the at least two rectangular or ridge waveguides to a further waveguide and a third junction for connecting an inner waveguide of the coaxial waveguide feed to a higher frequency range waveguide, characterised in that the transducer is formed from at least two parts joined across a first plane perpendicular to the longitudinal axis and including a part of the higher frequency range waveguide within the join. By "higher and lower" frequency is meant that there is a frequency difference between the higher and lower ranges. Typically, there is no overlap between the ranges.

Preferably, a water seal is provided in the plane of the first join. Preferably, all of the junctions include impedance matching devices. A feed horn may be attached to the coaxial feed. The feed horn preferably has corrugations. The first and second junctions may be provided by further parts which are joined to the other parts along planes parallel to the first plane. The horn is preferably sealingly attached to the first junction part along a plane parallel to the first plane. Preferably, a dielectric rod antenna is located in the inner waveguide at the end facing the horn. The end of the inner waveguide is preferably provided with a device for preventing backscattering from the rod antenna. The device is preferably a flare opening outwards towards the horn.

The transducer of the present invention allows the attachment of a higher frequency waveguide to the inner waveguide of the coaxial waveguide such that the higher frequency waveguide extends at an angle to the longitudinal axis of the transducer. The higher frequency waveguide extends at substantially 90° to the longitudinal axis of the waveguide. This distinguishes the present invention over those dual band transducers which extract both higher and lower frequency range waveguides parallel to the longitudinal direction.

The present invention will now be described with reference to the following drawings.

BRIEF DESCRIPTION OF THE DRAWINGS

FIGS. 5 to 8 shows various views of a first to a fourth part 50 of an OMT in accordance with an embodiment of the present invention.

FIG. 10 is a schematic cross-section of an inner waveguide for use with the embodiment of FIGS. 5 to 9.

FIG. 11 is a schematic cross-section of an antenna rod for use with the inner waveguide of FIG. 10.

DESCRIPTION OF THE ILLUSTRATIVE EMBODIMENTS

The present invention will be described with reference to certain embodiments and drawings but the present invention is not limited thereto but only by the attached claims.

Figure 1:
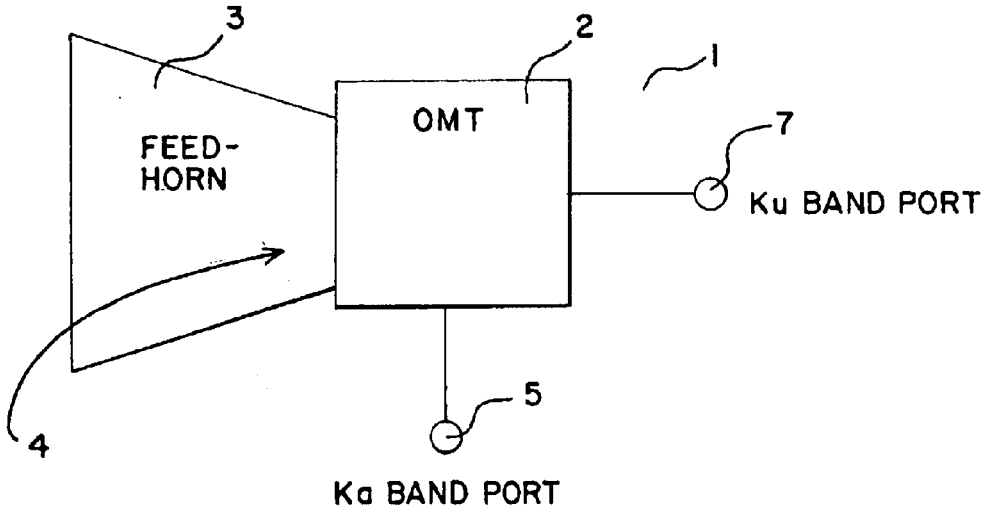
FIG. 1 is a schematic block diagram of an OMT and feed in accordance with an embodiment of the present invention.

FIG. 1 shows a schematic block diagram of an OMT and feed 1 in accordance with the present invention. It includes a feed horn 3 with feed aperture 4 and an OMT 2. The OMT 2 in accordance with an embodiment of the present invention is equipped with a first port 5 for a first frequency, e.g. the Ka band, normally used for (but not limited to) transmit and a second port 7 for a second frequency, e.g. the Ku band, normally used for (but not limited to) receive. Both ports 5, 7 preferably have standard interfaces allowing connection to a Ka band transmitter module and a standard Ku band LNB (low noise block downconverter) respectively.

Figure 2:
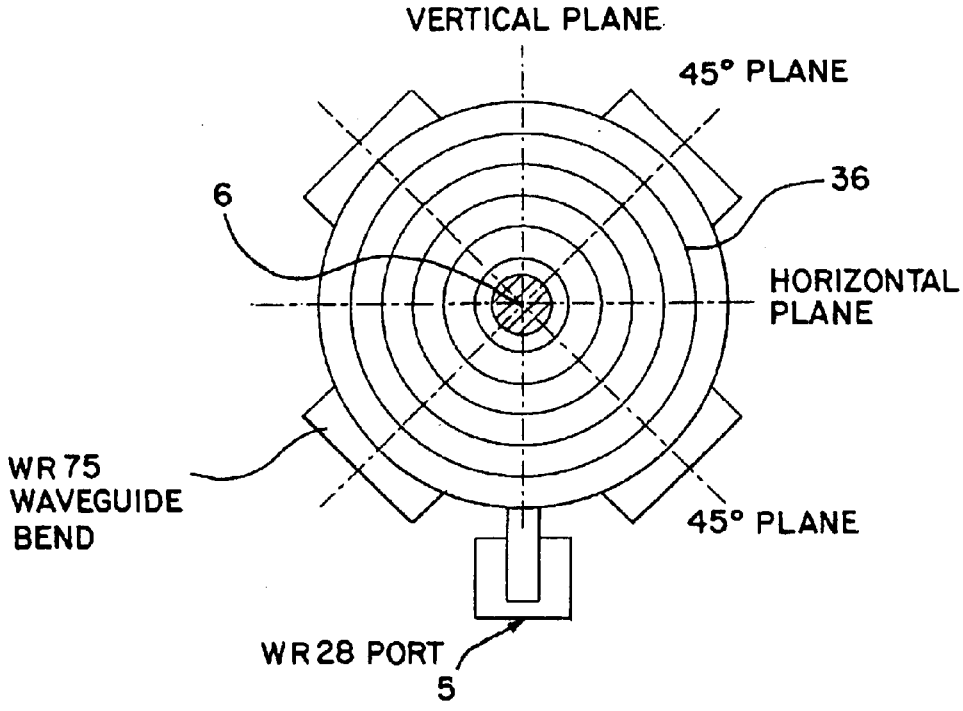
FIG. 2 is a schematic front-end view of the embodiment of FIG. 1.

FIG. 2 shows a schematic front view of the OMT and feed 1 as when looking into the feed aperture 4. This and the following figures present the case of the OMT and feed construction for horizontal polarisation in the Ka band. The case for vertical polarisation in the Ka band is obtained by rotating 90 degrees around the feed centre axis 6.

Figure 3:
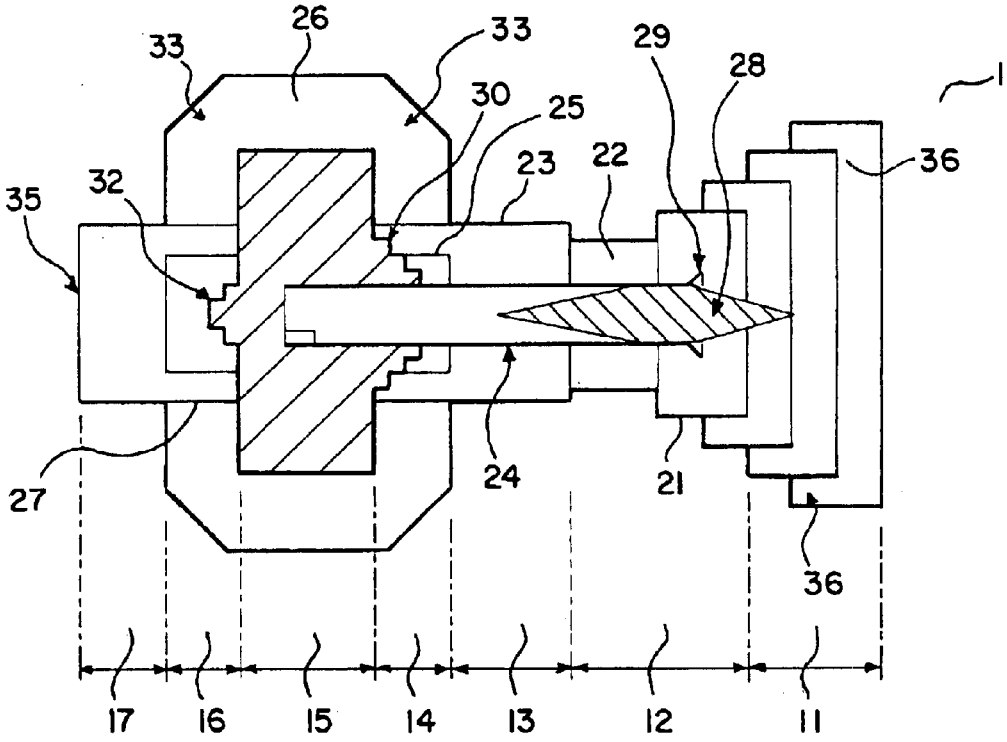
FIG. 3 is a schematic longitudinal section at 45° to the vertical of an embodiment of an OMT and feed in accordance with the present invention.

FIG. 3 show a schematic view of a longitudinal cross section of the OMT and feed 1 in any of the planes at 45 degrees to the vertical longitudinal plane. The OMT and feed 1 is made of conductive material such as a metal and comprises a corrugated horn section 11 having corrugations 36, a transition region 12 from a circular waveguide 21 to a coaxial waveguide 22 and an impedance matching section including a dielectric rod antenna 28 for beam forming the high frequency central waveguide 24, a coaxial waveguide section 13 in which a low frequency circular concentric waveguide 23 surrounds the central on-axis high frequency circular waveguide 24, a first coaxial waveguide H-plane turnstile junction 14 with four rectangular or ridge waveguide ports 25, an interconnection section 15 for four rectangular or ridge waveguides 26 having two E-plane bends 33, a second circular waveguide H-plane turnstile junction 16 with 4 rectangular or ridge waveguide ports 27, and a circular waveguide 17 with a circular waveguide interface 35 (Ku band).

Preferably, the exposed end of the inner waveguide 24 facing the horn 11 has a tube flare 29 which flares outwards in the direction of the horn 11. This flare 29 reduces entry of high frequency signals into the low frequency feed. Preferably, the first and second turnstiles 14 and 16 have impedance matching devices 30 and 32, respectively, which may be in the form of steps.

Figure 4:
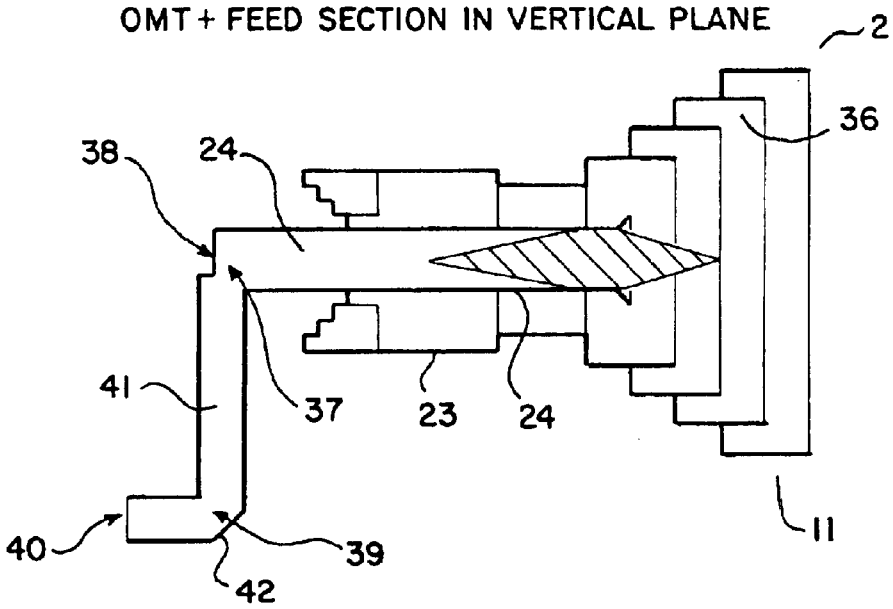
FIG. 4 is a schematic longitudinal vertical cross-section of the embodiment according to FIG. 3.

FIG. 4 shows a schematic cross section of the OMT 2 in the vertical plane. The end of the high frequency waveguide 24 remote from the horn 11 has a circular waveguide (24) to rectangular or ridge waveguide (41) transition 37, an H-plane waveguide bend 39 and a rectangular waveguide interface 40 (Ka band). The transition 37 preferably has an impedance matching device 38 such as a step and the bend 39 preferably has an impedance matching device 42.

Ku Band Operation

The corrugated feedhorn 11 collects the incoming spherical wave from a reflector dish (not shown) and converts this wave into a TE11 mode, propagating in the circular waveguide section 21 at the mouth of the horn 11. The dielectric rod antenna 28 is made of a material with low permittivity, and its presence will not significantly affect this propagation nor will it affect significantly the radiating properties of the corrugated horn 11.

At the transition 12 from circular 21 to coaxial waveguide 22 the signal is forced to propagate in between the outer and inner tubes 23, 24 as the diameter of the inner tube 24 is sufficiently small (and hence the cut-off frequency of the circular waveguide formed by this tube sufficiently high) to prevent propagation at Ku band down this tube. The signal propagates into the coaxial waveguide 22 formed by the outer and inner tubes 23, 24 according to the TE11 mode. Optional additional steps 9 in the diameter of the outer tube 23 provide matching of the discontinuity formed at the circular to coaxial waveguide transition 12 transition.

The coaxial waveguide section 13 terminates into an H-plane turnstile waveguide junction 14 with 4 rectangular waveguide branches 26. Depending on the polarisation of the incoming signal, the signal will be divided between the two pairs of branches 26, each pair collocated in the same 45 degrees plane. The signal will be divided equally between the two branches 26 constituting a pair.

The four rectangular waveguide branches 26 are connected with E-plane bends 33 and interconnection sections 15 to another H-plane turnstile junction 16 which collects the signal, coming from the 4 branches 26, and combines it into a circular waveguide 17. The polarisation of the signal coming out of the circular waveguide section 17 will be the same as the polarisation of the original signal going into the coaxial waveguide section 13 because the 4 rectangular branches 26 have the same length.

The received signal, independent of polarisation, is then obtained at the circular waveguide interface 35.

A single polarisation embodiment of the OMT and feed 1 in accordance with the present invention may be obtained by omitting one pair of the rectangular waveguide branches 26 and replacing the second H-plane turnstile junction 16, with an E-plane rectangular waveguide T-junction. The interface 35 is replaced by a rectangular waveguide port.

Ka Band Operation

The Ka band transmit signal is launched into the rectangular waveguide port 40, via an H-plane waveguide bend 39. It is routed to an H-plane transition 37 from rectangular to circular waveguide, including a matching step 38. This transition forces the signal into the inner tube 24, where it will propagate in the circular TE11 mode. The circular waveguide formed by this inner tube 24 serves as a launcher for the dielectric rod antenna 28.

The dielectric rod antenna 28 is excited in the hybrid HE11 mode of cylindrical dielectric waveguide. A flare 29 at the end of the inner tube 24 is provided in order to reduce the back radiation from the dielectric rod antenna 28, and also in order to launch the desired HE11 mode. The dielectric rod antenna 28 has two tapered ends, one tapered end to provide matching towards the circular waveguide 24, and one tapered end to provide matching towards free space.

The dielectric rod antenna 28, supporting the HE11 mode, radiates in a way similar to a corrugated feed horn, with identical radiation patterns in the E and H planes and low cross polarisation levels, and serves to illuminate the reflector dish.

The beamwidth of the dielectric rod antenna 28 is arranged to be smaller than the flare angle of the corrugated feedhorn 11 and the radiation from the dielectric rod antenna 28 will not significantly interact with the corrugated feedhorn 11. The amount of radiation from the dielectric rod antenna 28 that is backscattered by the corrugated feedhorn 11 into the coaxial waveguide 13 will therefore be small. For this reason and also because the back radiation from the dielectric rod antenna 28 is limited by the flare 29, a high amount of isolation is obtained at Ka band between the transmit waveguide port 40 and the receive waveguide port 35.

Mechanical Arrangement and Sealing

The OMT and feed embodiments described above can be realised using a number of mechanical parts that can be easily machined or manufactured by other methods such as a casting process. The design therefore allows large-scale production. The basic OMT 2 can be realised with 4 mechanical parts. The OMT 2 is split transversely to the longitudinal axis 6 of the OMT 2.

Figures 5A, 5B, 5C, 5D, 5E, 5F:
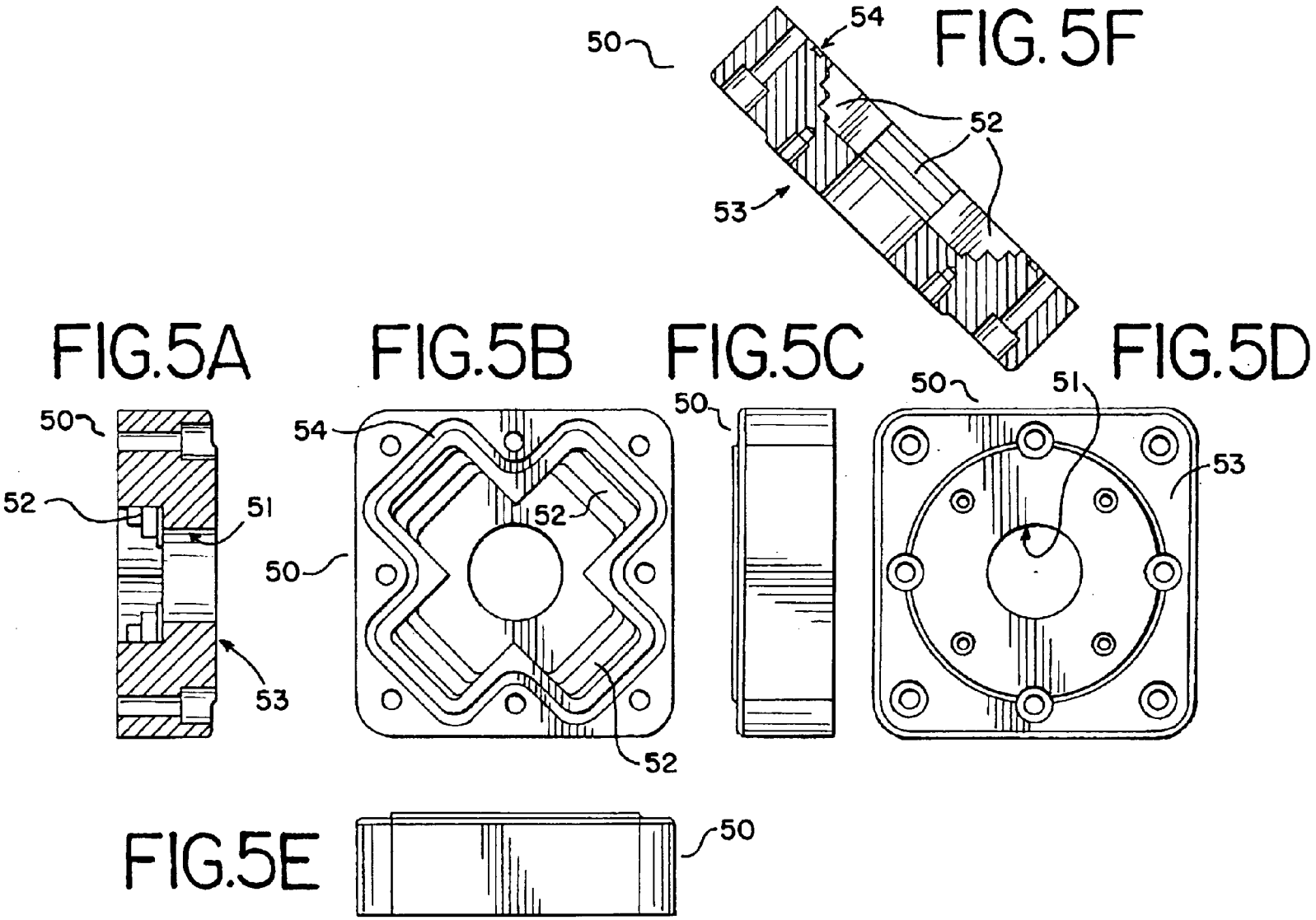
FIGS. 5*a* to 5*f* show respectively, 5*a*: a cross-sectional side view taken vertically through the first part 50; 5*b*: a view of the sealing face to the second part 60 looking towards the horn; 5*c*: a side view; 5*d*: a view of the face which is attached to the horn; 5*e*: a side view; and 5*f*: a cross-sectional view through the first part 50 taken along a 45° line to the vertical in FIG. 5*b* and passing through the centre line of the transducer.

FIG. 5 shows the first part 50 which may be generally of quadratic section. This part 50 corresponds to the coaxial waveguide section 13 and turnstile junction 14, and also includes the first set of the bends 33. The outer surface of the tube 23 is formed by the inner surface 51. The four E-bends 33 may be formed at 90° to each other from steps 52 or may be flat (two bends at 180° for the single polarisation alternative). The feed horn section 11 (see FIG. 9) is attached sealingly onto surface 53. A first groove 54 may be arranged easily to accept a sealing ring such as a conventional "O" ring for sealing to the second part 60.

Figures 6A, 6B, 6C, 6D, 6E, 6F, 6G, 6H:
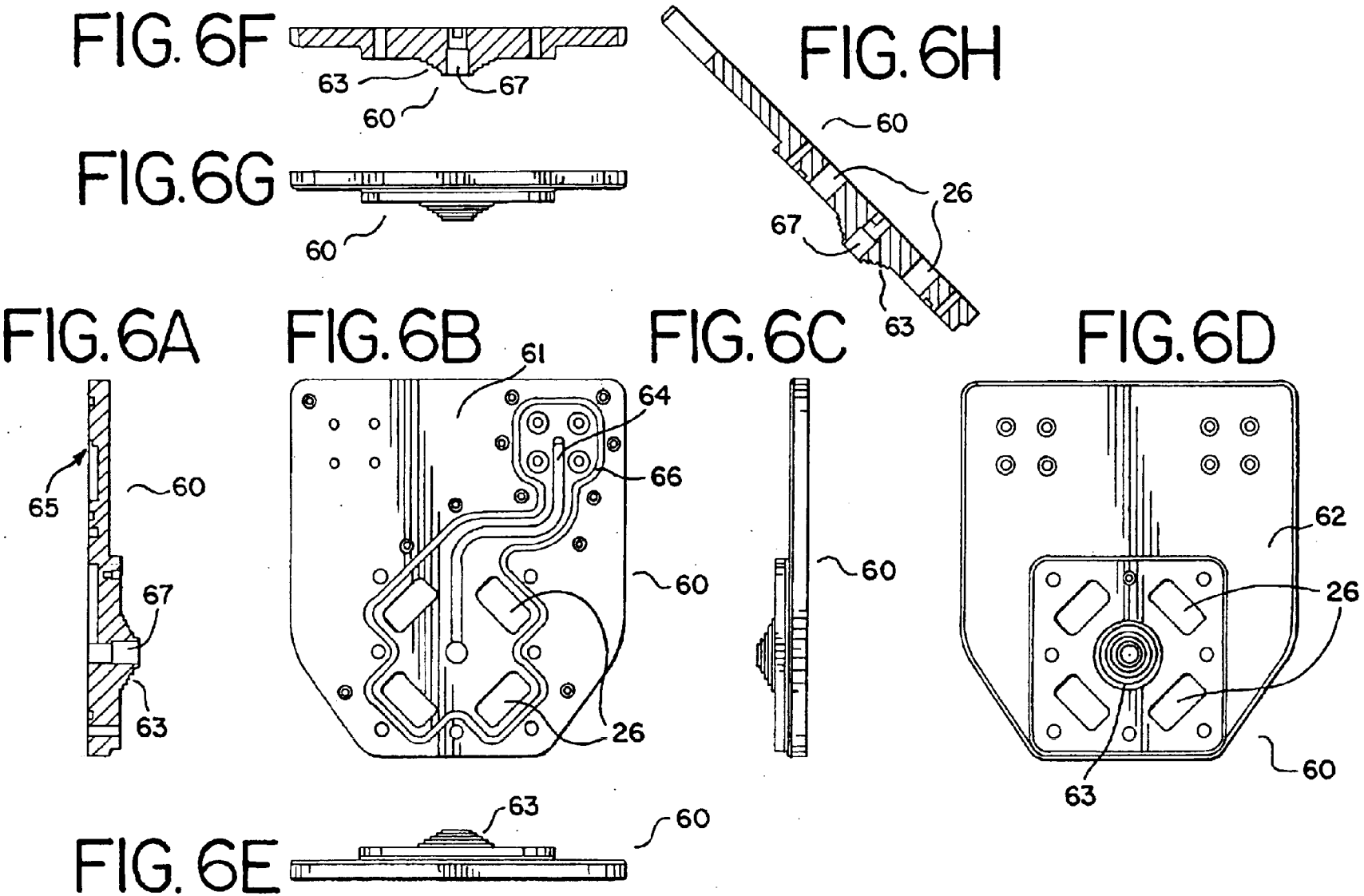
FIGS. 6*a* to 6*h* show respectively, 6*a*: a cross-sectional side view taken vertically through the second part 60; 6*b*: a view of the sealing face to the third part 70 looking towards the horn; 6*c*: a side view; 6*d*: a view of the face which is attached to the first part 50; 6*e*; a side view; 6*f*: is a cross-sectional view taken on a horizontal line in FIGS. 6*b*; 6*g*: is a side view; and 6*h*: a cross-sectional view through the second part 60 taken along a 45° line to the vertical in FIG. 6*b* and passing through the centre line of the transducer.

FIG. 6 shows the second part 60 which may be generally of quadratic section but may have any suitable shape. Part 60 corresponds to half of the interconnection section 15 and half of the transition 37. The inner tube 24 shown in FIG. 10 is attached to the second part 60 on side 62, for instance in a circular recess 67. The first part 50 is attached sealingly to the side 62. Four rectangular (or ridge) waveguide branches 26 are distributed at 90° intervals around the longitudinal axis 6 (two branches at 180° for the single polarisation alternative). The impedance matching device 30 may be provided by a series of steps 63 on side 62. The other major surface 61 includes a groove 64 which forms one half of the high frequency waveguide 41. The impedance matching device 39 may be provided by a step 65. A groove 66 may be provided for accepting a sealing ring, e.g. a conventional "O" ring for sealing to third part 70.

Figures 7A, 7B, 7C, 7D, 7E, 7F, 7G, 7H:
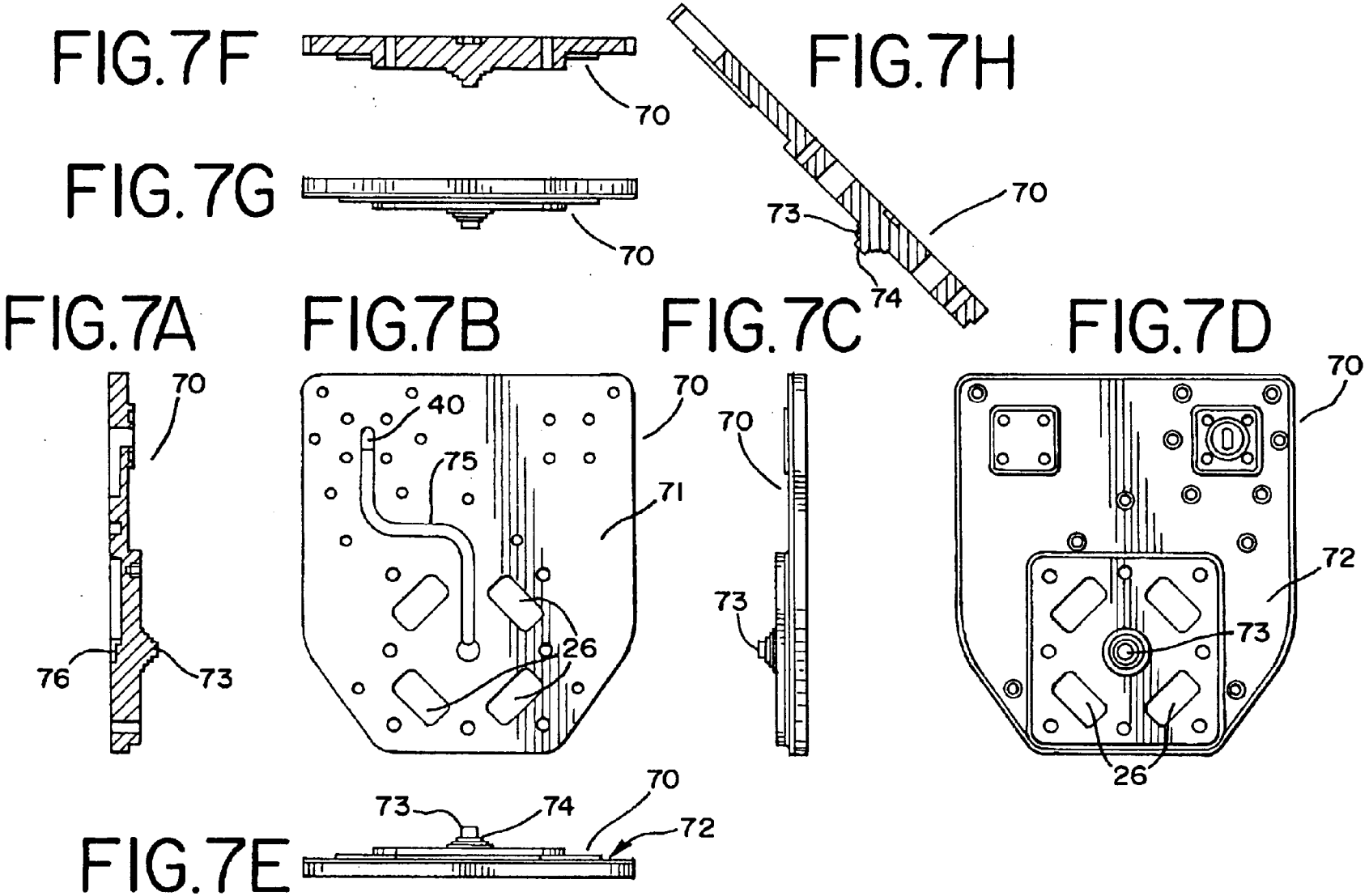
FIGS. 7*a* to 7*h* show respectively, 7*a*: a cross-sectional side view taken vertically through the third part 70; 7*b*: a view of the face which is sealed to the second part 60; 7*c*: a side view; 7*d*: a view of the face which is attached to the fourth part 80; 7*e*: a side view; 7*f*: is a cross-sectional view taken on a horizontal line in FIGS. 7*b*; 7*g*: is a side view; and 7*h*: a cross-sectional view through the third part 70 taken along a 45° line to the vertical in FIG. 7*b* and passing through the centre line of the transducer.
Figure 8F:
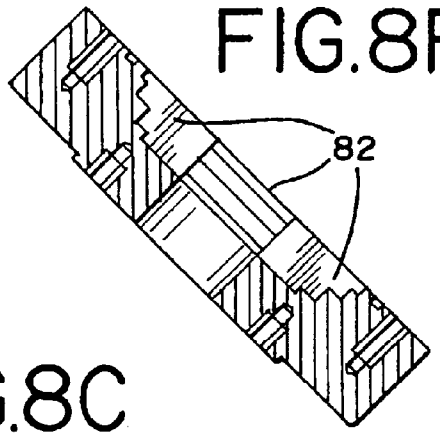
FIGS. 8*a* to 8*f* show respectively, 8*a*: a cross-sectional side view taken vertically through the fourth part 80; 8*b*: a view of the sealing face to the third part 70; 8*c*: a side view; 8*d*: a view of the face which is attached to the LNB; 8*e*: a side view; and 8*f*: a cross-sectional view through the fourth part 80 taken along a 45° line to the vertical in FIG. 8*b* and passing through the centre line of the transducer.
Figure 8D:
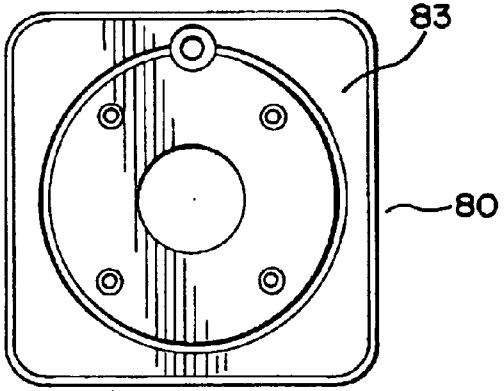
Figure 8C:
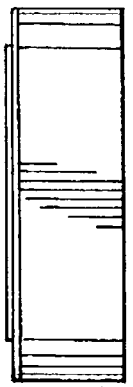
Figure 8B:
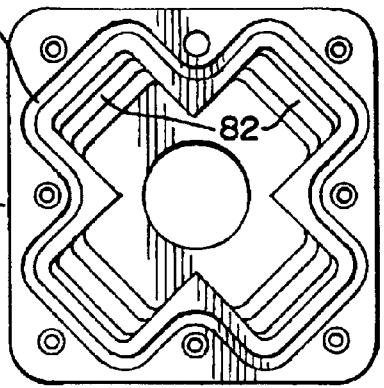
Figure 8E:
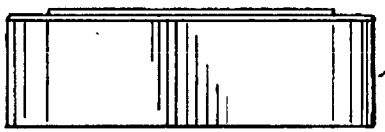
Figure 8A:
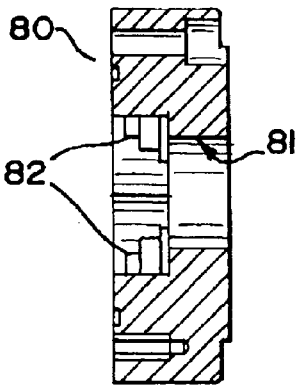

FIG. 7 shows the third part 70 which may be of generally quadratic section but the present invention is not limited thereto. This part 70 corresponds to half of the interconnection section 15 and half of the transition 37. This part 70 includes an H-plane waveguide bend 39 and a waveguide port 40. The second part 60 is attached sealingly to the side 71. Four rectangular (or ridge) waveguide branches 26 are distributed at 90° intervals around the longitudinal axis 6 (two branches at 180° for the single polarisation alternative). The branches 26 mate with the same branches in second part, 60. The impedance matching device 32 may be provided by a stud 73 and optionally a series of steps 74 on side 72. The side 71 includes a groove 75 which forms the other half of the high frequency waveguide 41 with groove 64 of second part 60. The impedance device 38 is formed by a step 76.

FIG. 8 shows the fourth part 80 which may be of generally quadratic section but the present invention is not limited thereto. This part 80 corresponds to the circular waveguide section 17 and second turnstile junction 16. It also includes the second set of four waveguide bends 33 arranged at 90° to each other (two bends at 180° for the single polarisation alternative). The outer surface of the circular waveguide 17 is formed by the inner surface 81. The four E-bends 33 may be formed from steps 82 or may be flat. The low frequency interface (LNB) is attached sealingly onto surface 83. A first groove 84 may be arranged easily to accept a sealing ring such as a conventional "O" ring for sealing to the third part 70.

Figure 9C:
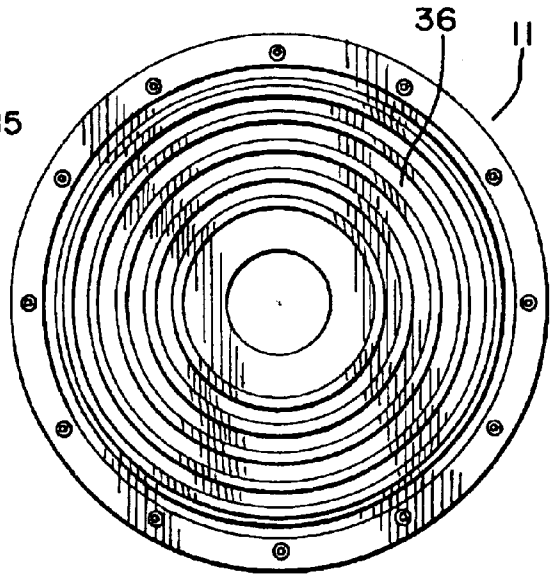
FIG. 9 is a schematic cross-section of a feed horn for use with the embodiment of FIGS. 5 to 8.
Figure 9A:
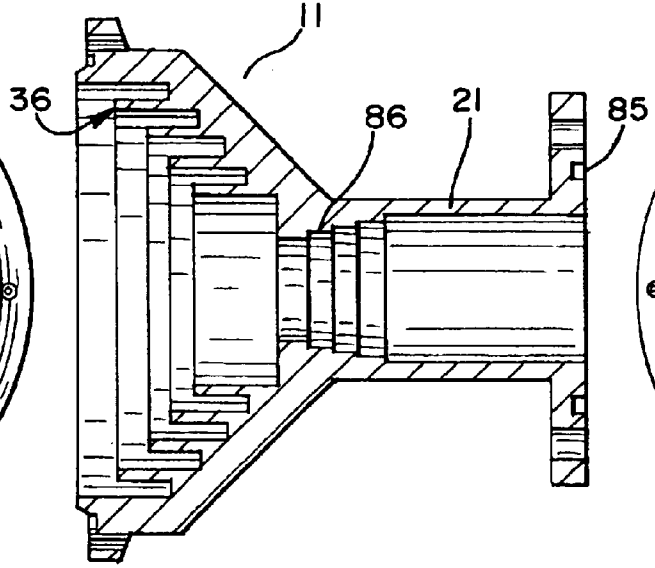
Figure 9B:
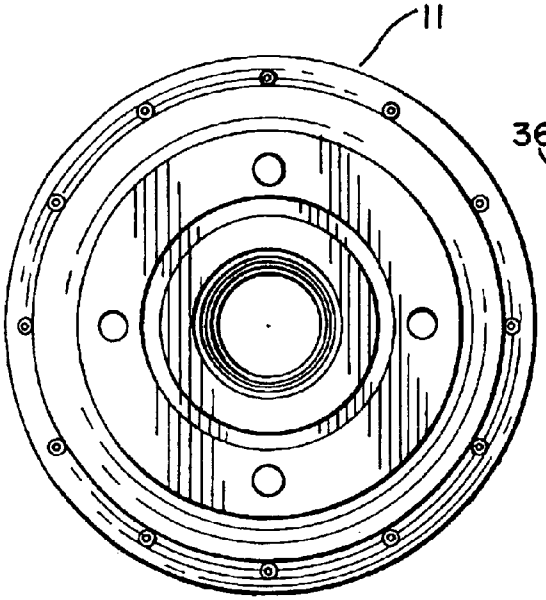
Figure 12:
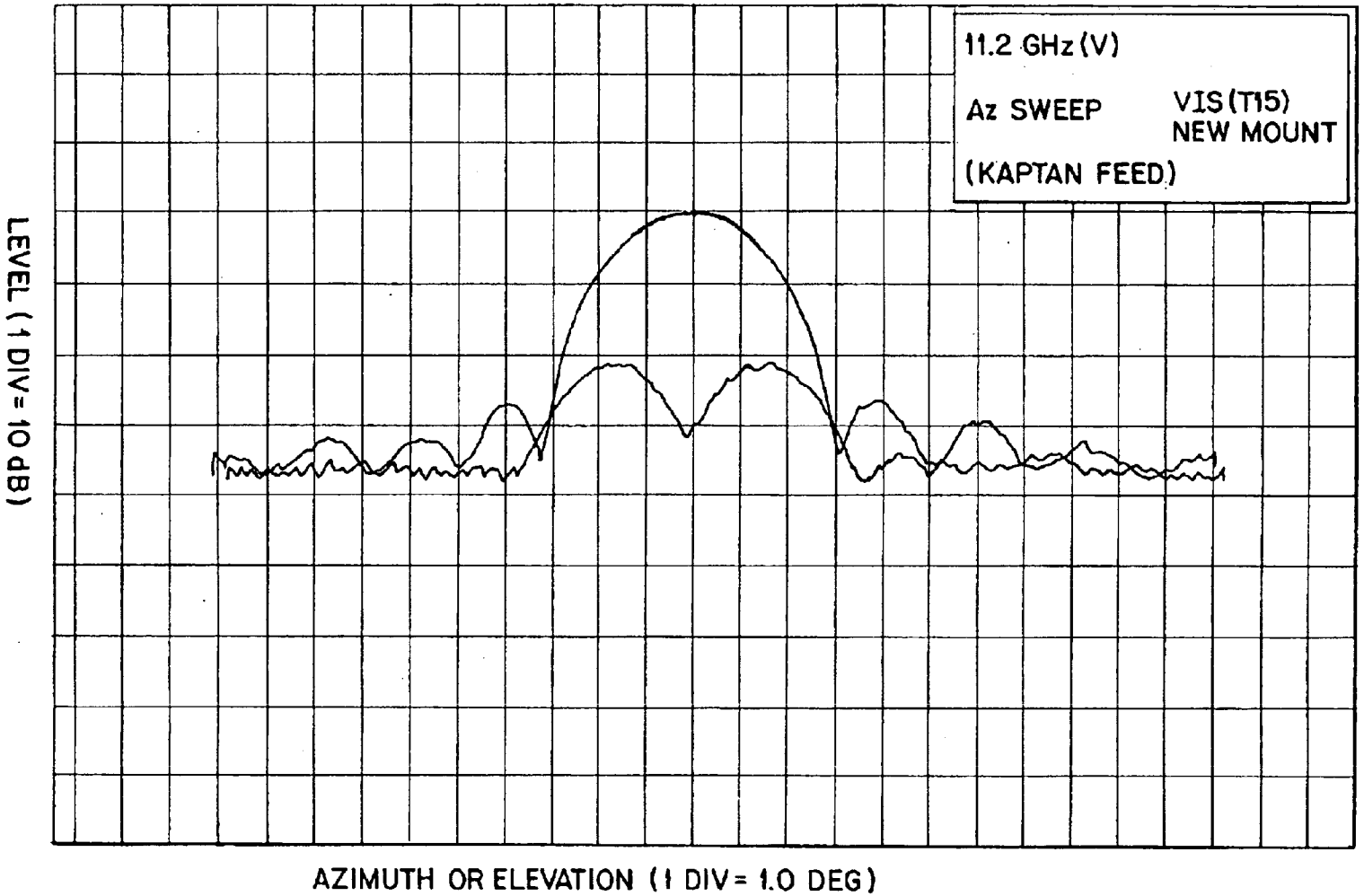
FIG. 12 shows radiation patterns of a 75 cm diameter offset reflector antenna equipped with a dual frequency band feed/OMT in accordance with the present invention: curve A shows a Ku band azimuth co-polar pattern at 11.2 GHz, curve B shows a Ku band azimuth cross-polar pattern at 11.2 GHz.
Figure 13:
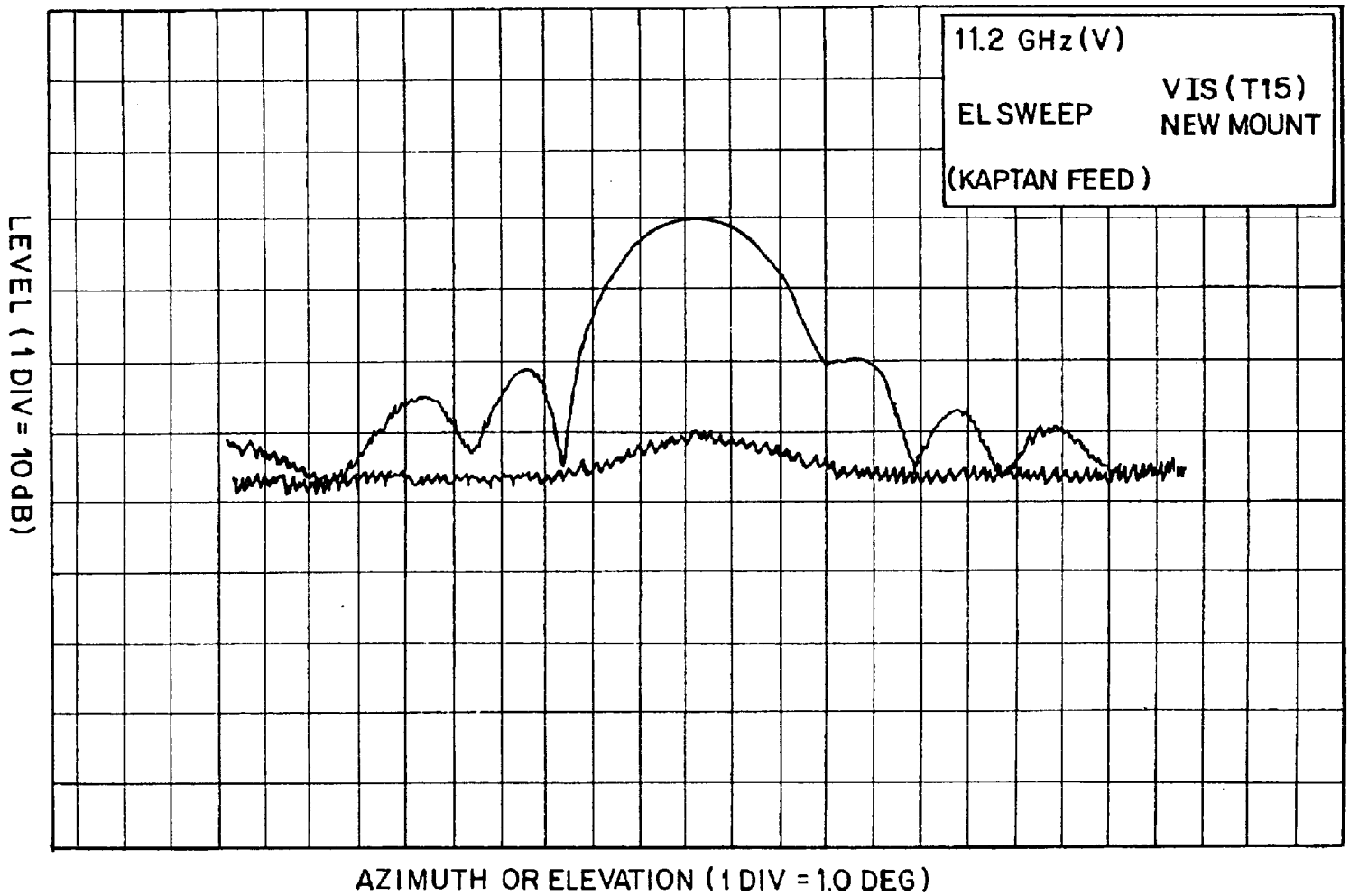
FIG. 13 shows radiation patterns of a 75 cm diameter offset reflector antenna equipped with a dual frequency band feed/OMT in accordance with the present invention: curve A shows a Ku band elevation co-polar pattern at 11.2 GHz, curve B shows a Ku band elevation cross-polar pattern at 11.2 GHz.
Figure 14:
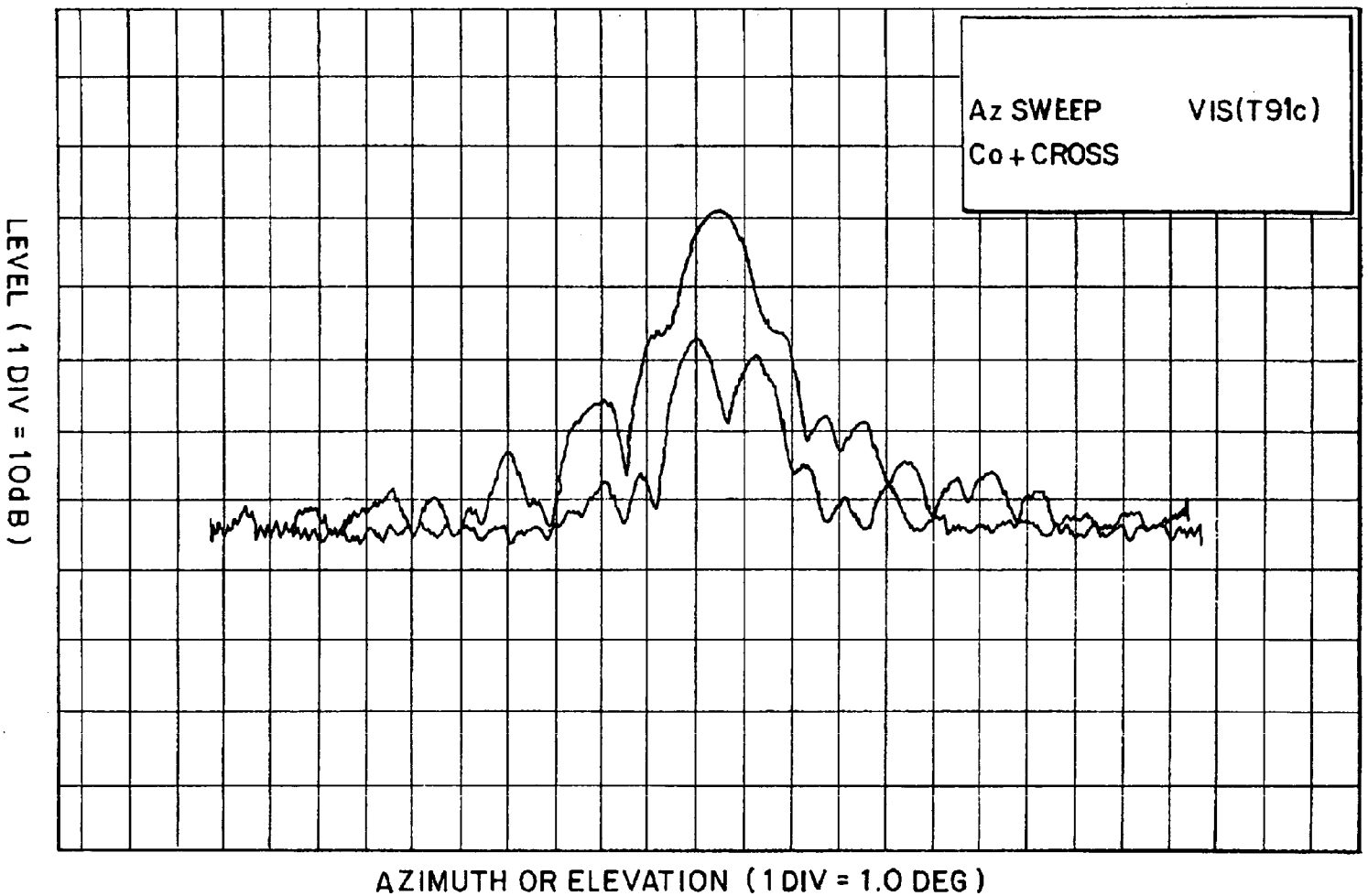
FIG. 14 shows radiation patterns of a 75 cm diameter offset reflector antenna equipped with a dual frequency band feed/OMT in accordance with the present invention: curve A shows a Ka band azimuth co-polar pattern at 29.734 GHz, curve B shows a Ka band azimuth cross-polar pattern at 29.734 GHz.
Figure 15:
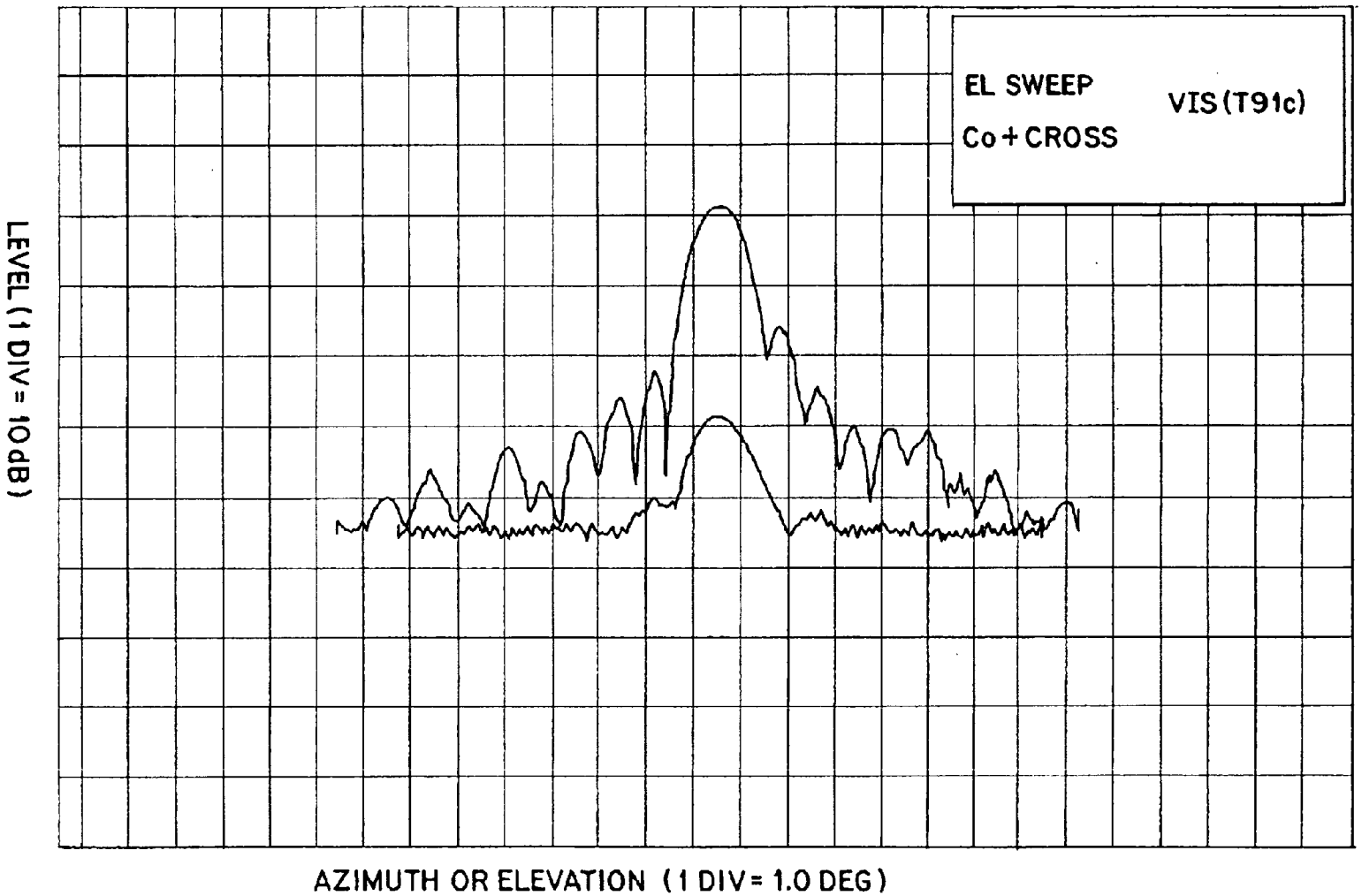
FIG. 15 shows radiation patterns of a 75 cm diameter offset reflector antenna equipped with a dual frequency band feed/OMT in accordance with the present invention: curve A shows a Ka band elevation co-polar pattern at 29.734 GHz, curve B shows a Ka band elevation cross-polar pattern at 29.734 GHz.

The first to fourth parts 50–80 may attached to each other by bolts through suitable bolt holes. The corrugated feedhorn 11 and the outer tube with the matching section 12 can be realised in a single piece as shown in FIG. 9. A groove 85 is provided for a sealing ring such as an "O" ring seal to first part 50. An impedance matching device 86 may be provided, e.g. steps in the diameter. An insulating plate (not shown) may be fitted into the wide end of the horn 11 to prevent rain, snow or moisture entry.

The inner tube 24 may be formed from a single tube with flared end (FIG. 10). The antenna rod 28 (FIG. 11) may be made as a light forced fit in the end of tube 24.

All parts 50–80 and the horn 11 can be bolted together. The parts 50–80 as well as horn 11 may be made by matching, casting or a similar process. The design also allows for inclusion of sealing rings, especially rubber "O" ring seals in between the parts in order to make the OMT+ feed assembly waterproof. In particular, the provision of a join plane between the second and third parts 60, 70 allows a convenient way of forming the high frequency waveguide 41 in a well-sealed manner without seals of complex geometry.

Performance

The performance results on a transducer in accordance with the present invention are summarised in tables 1 and 2. Test methods are according to internationally accepted standards such as ETSI EN 301 459 V1.2.1 (2000-10). Test made with a parabolic reflector were made using a visiostat reflector with aperture diameters of 75×75 cm (diameters of equivalent antenna aperture in plane perpendicular to parabolic axis) with a focal length of 48.75 cm, an offset angle of 39.95° (angle between bore-sight axis of feed and parabolic axis), a subtended angle of 74° (angle from focus subtended by reflector edge) and a clearance (distance between reflector edge and parabolic axis) of 2.5 cm.

FIGS. 12 to 15 are graphical representations of antenna patterns of a 75 cm reflector antenna with an OMT/feed in accordance with the present invention. The test results depend upon the diameter of the antenna dish which has been chosen as 75 cm as this is a common used standard size. The dish was from visiostat as described above. Better results can be obtained with a larger diameter dish, hence comparative results should be normalised to a 75 cm dish. Each test result given below, either individually or in combination, represents a technical feature of a transducer in accordance with an embodiment of the present invention. In particular, the present invention includes technical features provided by a combination of test results in accordance tables 1 and/or table 2.

TABLE 1

| Ka/Ku band feed-Horn OMT | | |
|---|---|---|
| Ku frequency band | 10.7–12.7 | GHz |
| Ka frequency band | 29.5–30 | GHz |
| Ka band port i/p return loss | at least 22 over frequency range | dB |
| Ku band port i/p return loss | at least 12 over frequency range | dB |
| Ka band to Ku band isolation | at least 35 over frequency range | dB |
| Ka band loss | ≦0.2 over frequency range | dB |
| Ku band loss | ≦0.2 over frequency range | dB |
| Ka band co-polar radiation pattern, feed taper | 8–10 | dB |
| Ka band co-polar radiation pattern, phase error | ≦±20 over frequency range | ° |
| Ku band co-polar radiation pattern, feed taper | 8–12 | dB |
| Ku band co-polar radiation pattern, phase error | ≦±20 over frequency range | ° |
| Ka band peak cross-polar level | ≧18 over frequency range | dB |
| Ku band peak cross-polar level | ≧19 over frequency range | dB |

TABLE 2

Performance of 75 cm offset reflector antenna with Ka/Ku band feed OMT*

| Ku band performance @ 11.2 GHz | | |
|---|---|---|
| 3 dB beamwidth | 2.3 | ° |
| Cross polar discrimination (XPD) within the 1 dB contour | at least 25 | dB |
| Off-axis antenna gain relative to on-axis maximum @ 2.5° from main beam axis | at least 16 over frequency range | dB |
| First sidelobe maximum relative to on-axis maximum @ 4° from main beam axis | at least 27 over frequency range | dB |
| Antenna efficiency | at least 65 | % |
| Ka band performance @ 11.2 GHz | | |
| 3 dB beamwidth | 0.9 | ° |
| Cross polar discrimination (XPD) within the 1 dB contour | at least 20 over frequency range | dB |
| Off-axis antenna gain relative to on-axis maximum @ 1.8° from main beam axis | at least 28 over frequency range | dB |
| First sidelobe maximum relative to on-axis maximum @ 1.3° from main beam axis | at least 17 over frequency range | dB |
| Antenna efficiency | at least 64 | % |

*these results are for plastic moulded reflector antenna with encapsulated metallic grid, slightly better results are obtained with solid aluminium reflectors While the present invention has been shown and described with reference to preferred embodiments it will be understood by those skilled in the art that various changes or modifications in form and detail may be made without departing from the scope and spirit of the invention.

What is claimed is:

1. A dual band, higher and lower frequency range transducer with a circular coaxial waveguide feed having a longitudinal axis, a first junction for connection of a lower frequency range outer waveguide of the coaxial waveguide feed to at least two rectangular or ridge waveguides offset from the longitudinal axis of the transducer, a second junction for connection of the at least two rectangular or ridge waveguides to a further lower frequency range waveguide and a third junction for connecting an inner higher frequency range waveguide of the coaxial waveguide feed to a further higher frequency range waveguide, wherein the transducer comprises at least first and second parts joined across a first plane substantially perpendicular to the longitudinal axis and including at least a portion of the further higher frequency range waveguide extending within the first plane of the join.

2. The transducer according to claim 1, wherein the further higher frequency range waveguide extends away from the inner higher frequency range waveguide of the coaxial feed in a direction at an angle to the longitudinal axis.

3. The transducer according to claim 1, wherein the further higher frequency range waveguide extends away from the inner higher frequency range waveguide of the coaxial feed in a direction substantially perpendicular to the longitudinal axis.

4. The transducer according to claim 1, further comprising a water seal provided between the first and second parts in the first plane of the join.

5. The transducer according to claim 1, wherein the at least one of first, second and third junctions includes impedance matching devices.

6. The transducer according to claim 1, further comprising a feed horn attached to the coaxial feed.

7. The transducer according to claim 6, wherein the feed horn has internal corrugations.

8. The transducer according to claim 6, wherein the horn is sealingly joined to the first junction part along a plane parallel to the first plane.

9. The transducer according to claim 1, wherein the first and second junctions comprise third and fourth parts which are joined to the first and second parts, respectively along planes parallel to the first plane.

10. The transducer according to claim 1, wherein a dielectric rod antenna is located in the inner higher frequency range waveguide at the end facing the horn.

11. The transducer according to claim 10, wherein a beamwidth of the rod antenna is smaller than a flare angle of the horn.

12. The transducer according to claim 10, wherein an end of the inner higher frequency range waveguide is provided with a device for preventing backscattering from the rod antenna.

13. The transducer according to claim 12, wherein the backscattering preventing device is a flare opening outwardly towards the horn.

14. The transducer according to claim 1, wherein the lower frequency range is 10.7 to 12.7 GHz and the higher frequency range is 29.5 to 30 GHz.

15. The transducer according to claim 1, wherein the first junction is a turnstile junction.

16. The transducer according to claim 1, wherein the second junction is a turnstile junction.

* * * * *